US006089395A

United States Patent [19]

Karttunen et al.

[11] Patent Number: 6,089,395

[45] Date of Patent: Jul. 18, 2000

[54] STORAGE CHEST FOR DRYING BATH TOYS

[76] Inventors: Patricia D. Karttunen; Timothy J. Bortka, both of 1231 E. Luray St., Long Beach, Calif. 90807

[21] Appl. No.: 09/257,860

[22] Filed: Feb. 26, 1999

[51] Int. Cl.[7] ..... B65D 6/08

[52] U.S. Cl. ..... 220/23.87; 206/77.1; 220/913; 220/DIG. 27

[58] Field of Search ..... 206/315.1, 579, 206/77.1; 220/676, 913, DIG. 27, 23.87; 34/232, 233, 235, 619, 622; 446/71, 75

[56] References Cited

U.S. PATENT DOCUMENTS

| | | | |
|---|---|---|---|
| D. 383,348 | 9/1997 | Frankel . | |
| 419,497 | 1/1890 | Caradine . | |
| 458,529 | 8/1891 | Williams . | |
| 2,297,843 | 10/1942 | Sharpnack . | |
| 2,318,842 | 5/1943 | Eaton . | |
| 2,403,858 | 7/1946 | Groom et al. . | |
| 2,656,640 | 10/1953 | Johnson et al. . | |
| 2,664,854 | 1/1954 | Talbot . | |
| 3,404,695 | 10/1968 | Paul . | |
| 3,688,895 | 9/1972 | Wilson | 206/77.1 |
| 3,899,073 | 8/1975 | Barr | 206/77.1 |
| 4,455,763 | 6/1984 | Elevitch | 34/233 |
| 4,513,525 | 4/1985 | Ward et al. . | |
| 4,698,042 | 10/1987 | Rubin . | |
| 5,022,527 | 6/1991 | Braeutigam | 220/913 |
| 5,212,902 | 5/1993 | Moorhead et al. . | |
| 5,266,763 | 11/1993 | Colombo | 220/23.87 |
| 5,279,412 | 1/1994 | Lee | 206/77.1 |
| 5,350,058 | 9/1994 | Keough . | |
| 5,702,003 | 12/1997 | Springer . | |
| 5,772,490 | 6/1998 | Leach . | |

*Primary Examiner*—Paul T. Sewell
*Assistant Examiner*—Luan K. Bui

[57] ABSTRACT

A storage chest and method for drying bath tub toys is disclosed. The chest includes a removable perforated drying basket nested inside the chest. The basket includes a peripheral flange that supports the basket in a position inside the chest suitably spaced from the side walls and from the base to accommodate sanitary drying of toys. The basket flange seats on a shoulder flange molded integrally with the chest and may be snugly retained by a press-fit bead molded integrally with a lid. Ventilation ports provided in the side walls and lid accommodate drying air circulation and may serve also as pouring spouts and as hand grips.

5 Claims, 3 Drawing Sheets

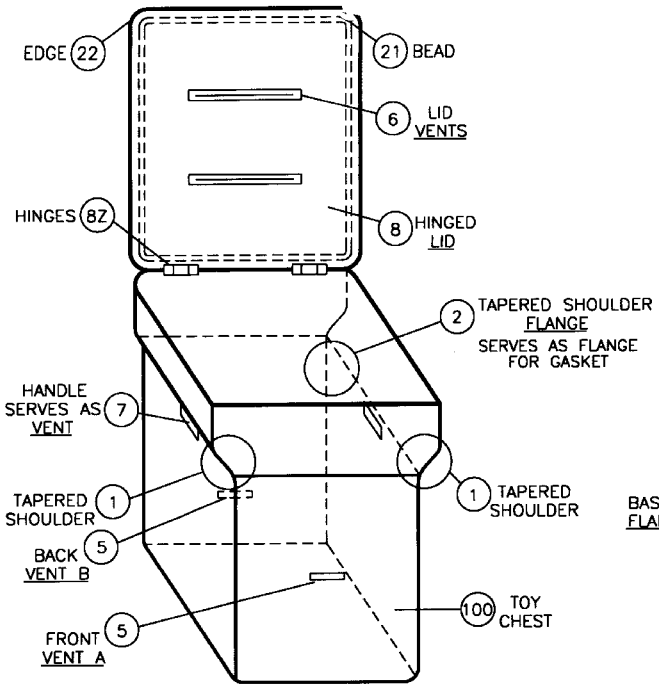

FIG. 1

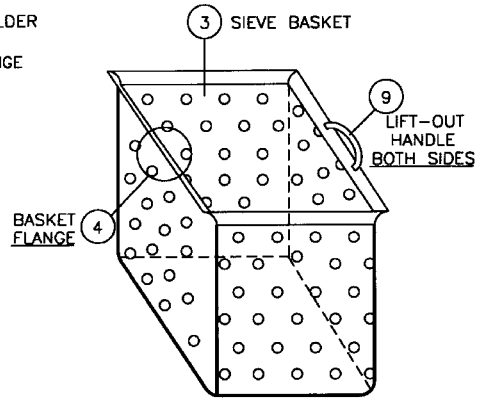

FIG. 2

FIG. 3A
"S" SHAPED FLANGE

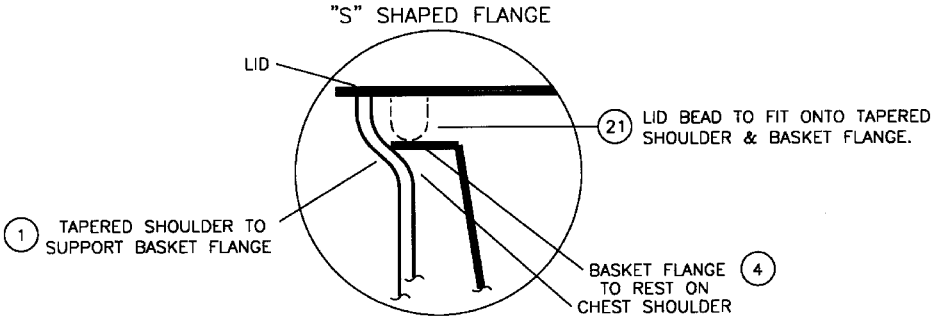

THE TOY CHEST (FIG.1) IS MOLDED OF PLASTIC WITH A TAPERED SHOULDER (1) NEAR THE TOP TO SUPPORT THE SIEVE BASKET (FIG.2) WHICH FITS INSIDE OF THE CHEST AND HAS A FLANGE (4) MOLDED AT THE TOP PERIMETER TO REST ON THE CHEST SHOULDER (1). CHEST VENTS (5) A/B AND LID VENTS (6) AS WELL AS CHEST HANDLES (7) SERVE AS VENTS AND ASSIST IN THE DRYING OF BASKET CONTENTS. THE CHEST LID (8) IS HINGED (8Z) FOR EASY ACCESS TO BASKET. TWO PLASTIC HANDLES (9) ARE MOUNTED ON EACH SIDE OF BASKET FOR EASY REMOVAL. A BEAD IS INTEGRATED INTO THE BOTTOM SIDE OF THE LID WHICH RESTS ON THE BASKET FLANGE AND HELPS TO LOCK IN BOTH THE LID AND BASKET ADDING STABILITY TO CHEST. EXCESS WATER DRAINED FROM BASKET CONTENTS ACCUMULATES IN THE BOTTOM OF THE CHEST AND CAN BE EASILY DUMPED OUT AFTER BASKET REMOVAL. THE "T" SHAPED FLANGES (3B) (IF USED), IN THE FRONT TWO CORNERS OF THE CHEST ARE NOTCHED OUT (10) TO ALLOW FOR EASY AND COMPLETE DRAINAGE.

NOTE: A FOOT PEDAL FOR LIFTING THE LID COULD ALSO BE UTILIZED FOR EASIER ACCESS.

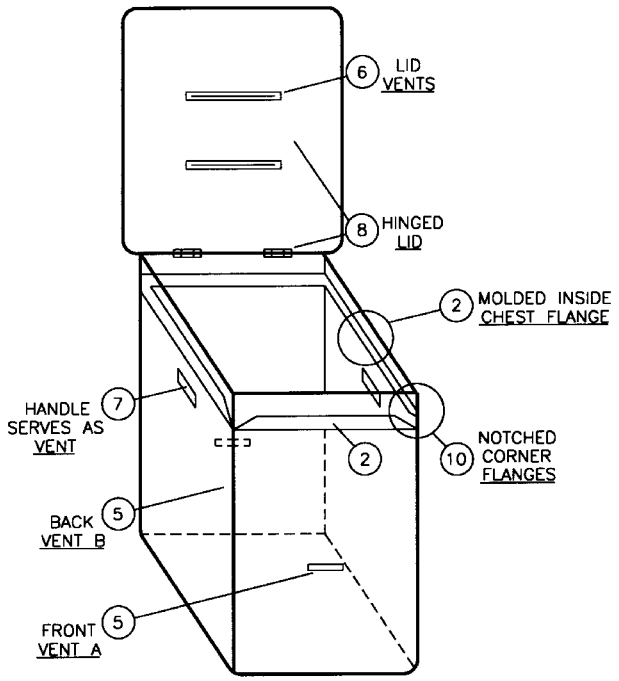
FIG. 1B
TOY CHEST
FIG. 3B
"T" SHAPED FLANGE
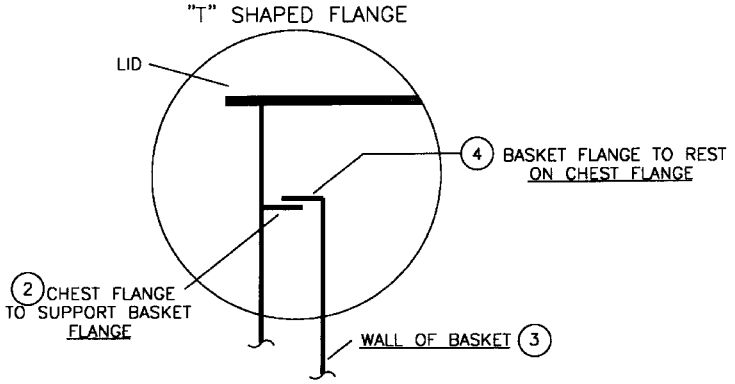

TOY CHEST

TOY CHEST

STORAGE CHEST FOR DRYING BATH TOYS

BACKGROUND OF THE INVENTION

The present invention relates to new and useful improvements in a storage box or toy chest for housing, organizing and drying bath tub toys and to a method of using the chest for drying bath tub toys. A Storage box for a water toy is known and has been developed using a non-removable drainage panel in a non-ventilated storage box for separating toys from a drain water reservoir located in the base of the box. See for example Rubin U.S. Pat. No. 4,698,042. Storage boxes with nested baskets have been employed for a variety of purposes such as for housing auto parts cleaner or for aerating fishing bait. Groom et al. U.S. Pat. No. 2,403,858 discloses a minnow box having handle holes 24 which serve also as a ventilation means. Other examples of containers with nested basket structures are shown in the following patents: Williams U.S. Pat. No. 458,529, Talbot U.S. Pat. No. 2,664,854, Moorhead U.S. Pat. No. 5,212,902, Johnson U.S. Pat. No. 2,656,640, Eaton U.S. Pat. No. 2,318,842 and Paul U.S. Pat. No. 3,404,695. While the use of containers having nested baskets is common for a variety of applications, the prior art does not disclose a safe, simple, attractive and ventilated chest with a removable nested basket wherein both the box and basket are each formed entirely from sanitary molded plastic for drying toys suspended above a reservoir and there remains a continued need for an improved toy drying chest which is easy and economical to manufacture and which does not detract from the safety or decor of a family or child's bathroom.

SUMMARY OF THE INVENTION

The present invention is a device and method for organizing and drying bath tub toys. The invention includes a waterproof plastic chest with a removable perforated plastic drain basket nested inside. The basket conforms to the shape of the container and is scaled to fit within the chest with sufficient side wall clearance to allow adequate air circulation around the basket. It is supported above the base of the chest a distance sufficient to accommodate a reservoir for safely holding bath water draining from the toys. The chest includes a hinged top lid covering substantially vertical side walls of the chest. The side walls may be molded with smooth corners and a slight incline or taper to facilitate molding and easy cleaning. The lid includes ventilation ports which may be slots extending parallel with the hinge pivot axis.

One object of the present invention is to provide a toy drying chest which is simple in design yet satisfies a wide range of practical and safety requirements for organizing a child's bath area.

Another object is to provide a toy drying chest which is easily manufactured in a single molding cycle.

Another object is to provide a toy drying chest which is sturdy in construction and which can be used as an auxiliary seating surface or stepping stool in a child's bath room.

Another object is to provide a toy drying chest which separates wet toys from drainage water and retains drain water safely in an integral reservoir which can be emptied periodically and conveniently without necessarily removing the toys from the chest.

Another object is to provide a toy drying chest which separates wet toys from drainage water and retains drain water safely in an integral reservoir which includes a basket for easily removing the toys and setting them aside so as to accommodate complete disposal of soiled bath water and thorough cleaning of the chest interior.

A still further object is to provide a method of using the chest for drying bath tub toys.

BRIEF DESCRIPTION OF THE DRAWINGS

FIG. 1 is a perspective view showing the ventilated toy chest with its lid open and its basket removed wherein the chest is molded with an "S" shaped flange for supporting a basket.

FIG. 1B is a perspective view showing the ventilated toy chest with its lid open and its basket removed wherein the chest is molded with a "T" shaped flange for supporting a basket.

FIG. 2 is a perspective view of the perforated basket when it is removed and separated from the chest.

FIG. 3A is an enlarged cross sectional view showing a tapered shoulder "S"-shaped chest-flange for receiving a basket flange and lid-bead when the lid is in its closed position.

FIG. 3B depicts an enlarged cross sectional view of an integrally molded "T" shaped shoulder flange.

DETAILED DESCRIPTION OF THE INVENTION

Figure 4:
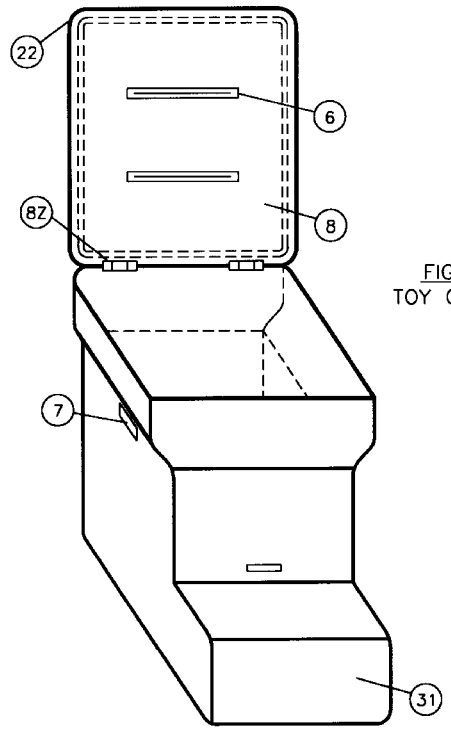
FIG. 4 is an alternative embodiment showing the toy chest of FIG. 1 with an optional integrally molded stair step extending horizontally forward from the front of the reservoir.

Referring now to the drawings, in particular FIG. 1, by way of reference numerals there is shown a toy chest 100 having a lid 8 attached by means of hinges 8*z*. The chest and lid are formed with few corners, seams or crevasses from smooth molded plastic such as polyethylene which is easily cleaned and which may optionally include integrally bonded anti-bacterial agents. The assembly includes a tapered shoulder flange 2 preferably molded integrally with the side walls of the chest. Shoulder flange 2 may be "S" shaped as shown in FIGS. 1 and 3A or "T" shaped as shown in FIGS. 1B and 3B. In either case, it supports a nested sieve basket 3 and may be molded integrally with the side walls above the reservoir as shown in FIG. 4 or may be attached at or near the open top of the chest for receiving a basket flange formed on a nested basket as shown in FIG. 3A and FIG. 3B. If flange 2 is formed as a "T" shaped flange as shown in FIG. 3B, it may be molded integrally with the side walls or attached to the side walls by bonding with adhesive or by welding, for example. When "T" shaped flanges are employed, notches 10 may be provided in corners where "T" shaped flanges would otherwise intersect and block complete drainage. Notches 10 thus accommodate easy and complete drainage of a chest having "T" shaped flanges.

Referring to FIG. 2, basket 3 includes a wide peripheral flange 4 surrounding its open top. Flange 4 is adapted for resting engagement upon chest flange 2 when the basket is seated in its nested position inside the chest. The basket flange cooperates with the chest flange to support the basket in a secure nested position spaced from the side walls and above the base.

Air vents integrally molded or cut into the side walls of the chest allow air flow to circulate through the chest to reach the internal perforated drying basket. These ventilation apertures, preferably in the form of horizontal slots 5, are formed in the side walls of the chest for cooperation with ventilation apertures or slots 6 formed in the lid. Slots 5 are positioned to foster a chimney effect that accommodates effective air circulation around the perforated basket so as to allow improved drying of toys contained in the basket. Slots 5 may serve also as drain ports for emptying water from the chest without necessarily opening its lid. Slots 5 may further include spout shaped edges (not shown) to accommodate pouring or emptying of accumulated bath water. Slots 7 may be positioned on the left and right side walls toward the open top end of the chest and may serve both as ventilation apertures for furthering the chimney effect and also as carrying handles that allow easy gripping of the chest so it can be lifted, emptied or moved about the room.

The lid is provided with hinges which may preferably be integrally molded "living hinges" formed when the chest and lid structures are molded. Optionally, the lid may further include on its under side, a peripheral raised bead structure 21 dimensioned and tapered to seat snugly into the open top of the chest for a press fit engagement when the lid is closed. This helps prevent the lid from shifting and locks the lid and chest together to form a sturdy container when the lid is closed. Bead 21 may have a height which reaches to engage the basket to help secure it into seating engagement with chest flange 2 when the lid is closed. The lid is preferably larger in area than the open top of the chest to provide an over-hanging edge 22. The over-hanging edge serves as an easily cleaned handle for gripping the lid and pulling it free from the chest during the process of lid opening. The top of the lid may optionally include a non-skid surface formed, for example, by an adhesively attached abrasive coating or laminate or by integrally molding an embossed or textured surface which resists slippage—yet is easily cleaned.

In use, the lid is opened and wet toys are deposited in the basket for drying. The lid is then closed to form an attractive bathroom furnishing while the toys drip dry in their ventilated basket. When the lid is closed the chest may become sturdy enough to support the weight of a small child and thus may serve also as a bathroom seat or stepping stool, for example.

Figure 5:
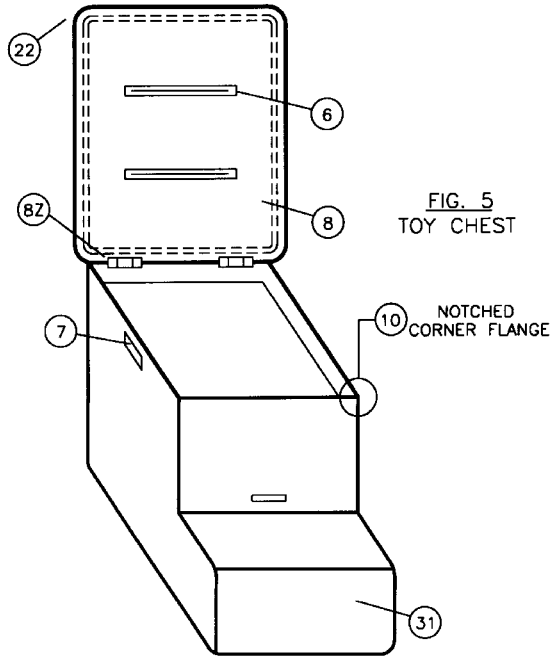
FIG. 5 is an alternative embodiment showing the toy chest of FIG. 1 with an optional integrally molded stair step extending horizontally forward from the front of the reservoir wherein the toy chest includes a "T" shaped flange in place of an "S" shaped flange for supporting a toy basket inside the chest.

If the chest is to be used as a stepping stool it may optionally further include a molded step structure 31 as shown in FIGS. 4 and 5 extending forwardly from the front of the base to accommodate a first stair step for the stool. Such an optional step structure may also be used to pin the chest on the floor when the lid is lifted by pulling it gently upward from its press fit engagement with the open top of the chest.

Bath water draining from the toys accumulates in the reservoir at the base of the chest and can be allowed to evaporate completely or can be emptied periodically as desired.

Alternatively, the lid can be opened and the handles of the perforated basket grasped firmly and pulled upwardly to withdraw the basket from the chest. The basket may then be drawn through the bath water in the manner of a dredge to quickly collect a variety of toys which may be floating or laying on the tub floor. The toy laden basket may then be returned to its nested position inside the chest and the lid closed for drying the dredged booty. When water drains from the toys it collects in the reservoir at the base of the chest and thus lowers the center of gravity of the chest to make it more stable and resistant to tipping and possible spillage.

The process of toy drying is an energetic one wherein a film of liquid water coating the large outer surface of toys evaporates. Thermal energy imparted to the toys by their previous contact with warm bath water, for example, may be stored in the thermal mass of toy materials to help power a passive convection pump or chimney effect. The structure of the chest and positioning of the vents helps facilitate the chimney effect by stirring-up static thermal gradients which would otherwise necessarily form when water molecules leave their liquid state to form their gaseous state during evaporation. Warm moist air rises while cooler dense vapor falls, condenses and drips down into the base reservoir upon the pull of earth's gravitational field.

It may be noted that various changes may be made in the details of construction without departing from the general spirit of the invention. Having thus fully described the invention, what is claimed is.

We claim:

1. A device for drying bath tub toys comprising;

a molded plastic storage chest having an open top;

a molded plastic lid covering said open top;

hinge means attaching said lid to said chest;

port means formed in said lid for ventilating said chest;

said port means formed in said lid as parallel slots;

side walls extending inwardly and downwardly from said open top to a closed base of said chest to form a bath water reservoir at said base of said chest;

at least one pair of slot shaped ventilating hand grip ports formed in said side walls above the level of said reservoir at least one slot shaped ventilating drain port formed in said side walls below the level of said hand grip ports and above the level of said reservoir inwardly extending shoulder flange means for supporting a removable perforated open top drain basket for drying bath toys in a nested position inside said chest, above said reservoir and spaced from said side walls, and;

a removable perforated open top drain basket formed from molded plastic resting upon said shoulder flange means.

2. the device of claim 1 wherein said shoulder flange means is integrally molded with said side walls adjacent said open top;

said basket includes flange means extending outwardly from the periphery of said open top drain basket for seating engagement with said shoulder flange means to suspend said basket inside said chest in a nested position such that said basket is spaced from said side walls a distance sufficient for circulation of drying air and spaced above said base a distance sufficient to accommodate a volume sufficient for said reservoir for retaining bath water separate from said toys.

3. the device of claim 1 wherein said lid is larger in area than said open top of said chest such that said lid forms an over hanging edge serving as an easily cleaned gripping handle for lifting said lid.

4. the device of claim 1 wherein said chest is cube shaped.

5. A method of drying toys comprising the steps of;

A. providing a device for drying bath tub toys comprising;

a molded plastic storage chest having an open top;

a molded plastic lid covering said open top;

hinge means attaching said lid to said chest;

port means formed in said lid for ventilating said chest;

said port means formed in said lid as parallel slots;

side walls extending inwardly and downwardly from said open top to closed base of said chest to form a bath water reservoir at said base of said chest;

at least one pair of slot shaped ventilating hand grip ports formed in said side walls above the level of said reservoir at least one slot shaped ventilating drain port formed in said side walls below the level of said hand grip ports and above the level of said reservoir inwardly extending shoulder flange means for supporting a removable perforated open top drain basket for drying bath toys in a nested position inside said chest, above said reservoir and spaced from said side walls, and; a removable perforated open top drain basket formed from molded plastic resting upon said shoulder flange means.

B. removing said basket from said chest

C. placing wet toys inside said basket;

D. placing said basket inside said chest, and;

E. thereafter allowing air circulation to enter said chest via said vents to contact said basket and thereby cause a toy drying action while liquid water drains from toy surfaces and accumulates in said base reservoir.

* * * * *